US009839801B2

(12) United States Patent
Kolacz et al.

(10) Patent No.: US 9,839,801 B2
(45) Date of Patent: Dec. 12, 2017

(54) FIREFIGHTING NOZZLE WITH TRIGGER OPERATED SLIDE VALVE

(71) Applicant: Task Force Tips, Inc., Valparaiso, IN (US)

(72) Inventors: David J. Kolacz, Plymouth, IN (US); Stewart G. McMillan, Valparaiso, IN (US)

(73) Assignee: TASK FORCE TIPS, INC., Valparaiso, IN (US)

( * ) Notice: Subject to any disclaimer, the term of this patent is extended or adjusted under 35 U.S.C. 154(b) by 0 days.

(21) Appl. No.: 15/140,267

(22) Filed: Apr. 27, 2016

(65) Prior Publication Data

US 2016/0317850 A1 Nov. 3, 2016

Related U.S. Application Data

(60) Provisional application No. 62/155,061, filed on Apr. 30, 2015.

(51) Int. Cl.
*A62C 31/02* (2006.01)
*A62C 31/03* (2006.01)
(Continued)

(52) U.S. Cl.
CPC ..... *A62C 31/03* (2013.01); *B05B 1/12* (2013.01); *B05B 1/304* (2013.01); *B05B 12/002* (2013.01)

(58) Field of Classification Search
CPC ..... A62C 31/005; A62C 31/02; A62C 31/03; A62C 31/12; B05B 1/12; B05B 1/3013;
(Continued)

(56) References Cited

U.S. PATENT DOCUMENTS 2,984,418 A * 5/1961 Dickmann ..... B05B 1/083 239/382
3,282,511 A * 11/1966 Barton ..... A62C 31/005 239/413

(Continued)

OTHER PUBLICATIONS

International Search Report and Written Opinion correspondence to International Application No. PCT/US2016/029589, dated Jul. 27, 2016 (8 pages).

*Primary Examiner* — Darren W Gorman
(74) *Attorney, Agent, or Firm* — Maginot, Moore & Beck LLP

(57) ABSTRACT

A firefighting nozzle comprises an elongated barrel having a inlet opening at one end for engaging a source of fluid under pressure and a discharge opening at an opposite end for engaging a discharge element for dispensing the fluid under pressure. A valve arrangement includes a slide valve element slidably mounted within the barrel for reciprocating movement along the length of the barrel to adjust the flow of fluid through the barrel. The nozzle includes a pistol grip trigger assembly mounted on the barrel that includes a segment gear pivotably for engaging a toothed surface of the slide valve element so that rotation of the segment gear causes reciprocation of the slide valve element. A four-bar linkage arrangement is incorporated between a manually actuated trigger to translate depressing the trigger to controllable reciprocation of the slide valve element. The four-bar linkage provides a mechanical advantage that allows the firefighter to easily control the trigger and thus the fluid discharge from the nozzle.

18 Claims, 19 Drawing Sheets

(51) Int. Cl.
*B05B 1/12* (2006.01)
*B05B 1/30* (2006.01)
*B05B 1/32* (2006.01)
*B05B 12/00* (2006.01)

(58) Field of Classification Search
CPC ..... B05B 1/3026; B05B 1/3033; B05B 1/304; B05B 1/3073; B05B 1/32; B05B 1/326; B05B 12/002
USPC ..... 239/289, 456, 525, 526, 600; 137/269
See application file for complete search history.

(56) References Cited

U.S. PATENT DOCUMENTS 3,888,421 A 6/1975 Chow
4,252,278 A 2/1981 McMillan
4,589,439 A * 5/1986 Steingass ..... A62C 31/02 137/219
4,776,517 A 10/1988 Heren
5,064,170 A * 11/1991 Feyen ..... B05B 12/002 251/111
5,261,494 A * 11/1993 McLoughlin ..... A62C 31/03 169/70
6,007,001 A * 12/1999 Hilton ..... A62C 31/03 239/452
2003/0127541 A1* 7/2003 Marino ..... B05B 1/12 239/539
2005/0133636 A1 6/2005 Steingass et al.
2005/0274825 A1* 12/2005 Seguin ..... A62C 31/02 239/525
2014/0084083 A1* 3/2014 Jenkins ..... A62C 31/02 239/393
2014/0138565 A1* 5/2014 Mcloughlin, Jr. .... B05B 1/1663 251/242

* cited by examiner

FIREFIGHTING NOZZLE WITH TRIGGER OPERATED SLIDE VALVE

REFERENCE TO RELATED APPLICATION

This application is a non-provisional utility application claiming priority to provisional application No. 62/155,061, filed on Apr. 30, 2015, the entire disclosure of which is incorporated herein by reference.

BACKGROUND

This disclosure relates to handheld nozzles connected to a fire hose. Firefighters often use this type of nozzle to extinguish fires in situations such as homes, cars, flammable liquid spills, and commercial properties where critical flow rates of at least 95 GPM (360 L/min) and pump pressures of at least 100 PSI (7 bar) are needed to overcome the fire. These nozzles develop reaction force of at least 50 lbf (23 kg) as a result of accelerating the water to velocities need for projecting fluids such as water acceptable distances and to form droplets into effective sizes. It's not uncommon for the reaction force to exceed half the weight of a firefighter. The physical limits of firefighters are oftentimes stretched to their maximum in the few moments a heavily laden firefighter with air pack rushes up many flights of stairs to rescue victims, setup firefighting equipment, and battle the blaze in incredibly hot rooms with near zero visibility conditions.

Added to that are forces from typical 1¾" (45 mm) diameter hose filled with water, and the associated stiffness which increase the effort of restraining the nozzle to direct the trajectory in the desired direction. One hand has traditionally been dedicated towards this task, while a second hand is used to open and close the valve feeding water to the nozzle, leaving no hands free to help stabilize the fireman, drag hose, or tend to a hundred other tasks which might prove beneficial.

Dedicating a second hand to operating a valve handle has been the expectation given that the force to move lever operated valve handles is fairly high owing to the large frictions and forces resulting from high fluid pressure. For example National Fire Protection Association standard NFPA 1963, 2013 edition requires valve lever operating forces between 3 lbf (13.4 N) to 16 lbf (71.2 N) per section 4.6.3. Prior to institution of this standard it was not uncommon for valve handle levers to operate with at least 40 pounds pull.

Trigger operated nozzles are those whose valve is operated by a gripping force of the fingers. It's not uncommon to see nozzles of this type used for purposes such as use from a garden hose, for agricultural irrigation, chemical spraying (including pesticides and herbicides), paint spraying, or wash-down. This type of valve allows one to use a single hand to hold and operate the nozzle, and allows the flow to quickly turn on, and for the valve to shut off quickly by itself.

Triggers are not used to move a traditional valve on a firefighting nozzle. Lever handles on firefighting nozzles generally move along an arc distance of about 8 inches (20 cm) while a comfortable finger grip motion distance for a trigger is not even a fourth of that. Therefore an ordinary firefighting valve simply fitted with a trigger instead of a lever would have at least four times higher operating force. Finger muscles on this trigger would therefore be required to produce over four times as much force as the more powerful arm and shoulder muscles moving a lever. Inherently, this approach sounds unworkable.

Trigger operated nozzles are commonplace in small firefighting hoses at far lower flows, which is to say 1" diameter hose (25 mm) and flows 60 GPM (240 L/min) or less. Trigger valves of a wide variety lend themselves to these conditions because a person's strength far exceeds operational forces encountered making trigger valves acceptable from an ergonomics standpoint.

Trigger valves lend themselves to the rapid valve on/off pulsing techniques found to be beneficial in controlling the atmosphere of rooms filled with un-ignited highly flammable superheated combustion byproducts, but up until now these nozzles were produced with maximum flows generally considered to be too small for safe structural (residential and commercial) firefighting. This technique is sometimes referred to flashover pulsing.

However, up until now larger sized trigger valves have not been commercialized for firefighting (larger, as described in the opening paragraphs) because of various obstacles to scaling up their size which made their use unacceptable, including reasons such as;

- Fingers don't produce enough force to comfortably open a substantially larger valve element because fluid pressure acting on larger areas results in larger forces.
- Frictional forces and seal drag caused by preload and fluid pressure to move larger valve elements make it difficult for fingers to operate the trigger.
- Once opened, significant closing forces are often generated by fluid pressure and dynamic velocity in valve types used on small trigger nozzles. These forces while insignificant in smaller valves can become untenable if scaled up to larger valve sizes making it difficult for fingers to retain the valve in an open position.
- Engaging a locking device to retain a valve in a flowing position generally cancels the safety benefits of a self-closing valve in the event of loss of grip on the nozzle. An unrestrained garden hose nozzle carries little risk of injury, whereas a 1¾" hose whipping at 50 MPH can kill nearby people.
- Trigger valves typically shutoff in an instant which is OK for small trigger nozzles, but becomes detrimental with larger sizes as nearly instantaneous deceleration of a large water mass produces significant water hammer which carries risks such as injury from catastrophic hose rupture, loss of extinguishing or protective flow, and the physical stress of sudden impulse change.
- Physical size and weight of the nozzle would become unacceptably large if smaller trigger valves were simply scaled up.
- Scaling up a small valve scales up the stroke needed to achieve a reasonable flow which also scales up the distance required operate a trigger to where it becomes larger than the grip capacity of a typical person's fingers.
- Trigger valves generally are arranged so that the liquid enters the nozzle from the bottom and undergoes a direction change as it passes thru the front of the nozzle, thus the nozzle trajectory is neither parallel nor co-linear with the hose feeding it. As a result the hose is not positioned to absorb significant portions of the nozzle reaction force.

Prior nozzles employing hydraulic control circuits such as disclosed in U.S. Pat. No. 5,261,494 to McLoughlin et. al. (the disclosure of which is incorporated herein by reference) move sliding valve elements between open and closed positions using chambers of water opened and closed by trigger position. However these valves have no positive mechanical engagement between trigger and sliding element so the position of the sliding element with respect to the trigger is subject to some uncertainty. For example; one could expect the valve to be fully closed at the start of a fire based on trigger position, only to find the valve element stuck open from lack of lubrication, corrosion, or from water supplies to the hose being terminated with the trigger depressed. Furthermore, water in hydraulic control circuits is subject to freezing in cold temperatures thus disabling the valve sooner than freezing occur in the full diameter of the waterway of a mechanically operated valve. Although springs added to the moving element could improve uncertainty somewhat, prudent safety practices would discourage use of hydraulically controlled trigger valves.

All of the prior firefighting nozzles will exhibit at least one of the drawbacks described above if scaled up. Moreover, all of the commercially available trigger operated firefighting nozzles have the water enter the bottom of the nozzle, at a significant angle to the discharge line of action.

Lever handle slide valves have found widespread use in the field because of the ease of which the handle may be operated, and the relative lack of turbulence. Attempts to move slide valves of this type by a straight linear pull, or by using a simple lever with a pivot point have resulted in valves with substantial risk of water hammer, and relatively high forces on the slider making them difficult to open with finder pull, and susceptible to self-opening or closing tendencies at various flows and pressures. A new mechanism therefore is needed.

SUMMARY OF THE DISCLOSURE

The present invention contemplates a trigger valve for a firefighting nozzle with flow rates of at least 95 GPM (360 L/min) and pump pressures of at least 100 PSI (7 bar) which has a combination of at least two or more of the following attributes:

- A trigger operated slide valve that can be restrained, opened, and closed with only one hand;
- A valve with opening forces low enough to permit the fingers to comfortably open a substantially larger valve element against forces generated by fluid pressure acting on a slider with a substantially large waterway;
- A valve whose frictional forces and seal drag are modest enough for the fingers to comfortably move a slider with a substantially large waterway against forces caused by preload and fluid pressure;
- A valve that once opened, has modest closing forces, making it easy for fingers to retain the valve in an open position;
- A locking device to retain a valve in a flowing position which self-disengages to yield "dead man control" safety benefits of a self-closing valve in the event of loss of grip on the nozzle. An unrestrained nozzle under high flow tends to whip violently resulting in risk of death by blunt force trauma;
- A valve whose closing speed is infinitely adjustable to a variety of speeds where in one extreme condition it will shut off almost instantaneously, and in another extreme shuts off over several seconds, thereby allowing the firefighter the ability to optimize the best balance between water hammer and closure in a timely manner. A nearly instantaneous deceleration of a large water mass produces significant water hammer which carries risks such as injury from catastrophic hose rupture, loss of firefighting ability, and the physical stress of sudden impulse change, whereas closure in too long of a time results in risk of hose whipping in the event of loss of grip on the nozzle;
- A nozzle whose physical size and weight is acceptable when compared to nozzles of similar flow capability;
- A valve whose trigger has a stroke of a length comfortable to the grip capacity of a typical person's fingers;
- A trigger valve arranged so that the liquid enters the nozzle from the back, and passes flow to the front of the nozzle resulting with a nozzle discharge trajectory that is nearly parallel or co-linear with the hose feeding it which results in several benefits including;
  - The hose is positioned to absorb significant portions of the nozzle reaction force while a firefighter is in the standing position. Standing positions are ideal for exterior fire attacks such as wild-land fires, but are dangerous during interior fire attacks because thick smoke, gasified explosive fuel, and heat all accumulate at the ceiling. Therefore firefighters position themselves on the floor in a crawling, kneeling, or lying stance while operating inside buildings during interior structural fire attacks;
  - When firefighters are positioned on the floor, fire hose is easier to drag when the hose is laid parallel to the direction of travel towards the fire, especially when advancing down a long narrow hallway;
  - When firefighters are positioned on the floor, there is equal freedom to swing the nozzle from side to side, or up and down without having to fight the angle of the hose inlet;
  - When firefighters are positioned on the floor, firefighters know that hose is being advanced into a "cool zone" which they formerly occupied rather than being forced to arch to the left or right by the angle of the hose inlet which could potentially place the hose in hot embers, down stairways, or down through holes burnt in the structure. As a result there is less risk of water depravation by hose burning thru. Since visibility is oftentimes nonexistent, firefighters must follow the hose by feel into or out of the fire. It could be life threatening to mistakenly follow a hose into a hole or down stairs;
- A pistol grip with trigger which can be built as a self-contained replaceable subassembly which can be attached onto a variety of valves;
- A pistol grip with trigger subassembly which can be built with differing lengths of stroke appropriate to either flow larger volumes of water at lower pressures by using a longer stroke with lesser mechanical advantage, or to flow smaller volumes of water at higher pressures by using a shorter stroke with greater mechanical advantage. As a result finger pull is not compromised in either condition;
- A valve body with an outlet connection which can accept a variety of nozzle front ends, including those permanently installed as well as a hose threaded discharge;
- A pistol grip whose grip surface is easily replaced in the event of excessive wear from dragging over pavement, being dropped, or being driven over;
- A pistol grip whose grip surface is easily interchangeable with those produced in other colors;
- A trigger valve that is mechanically connected to push and pull a slider between its open and closed positions.

DETAILED DESCRIPTION

Figure 1:
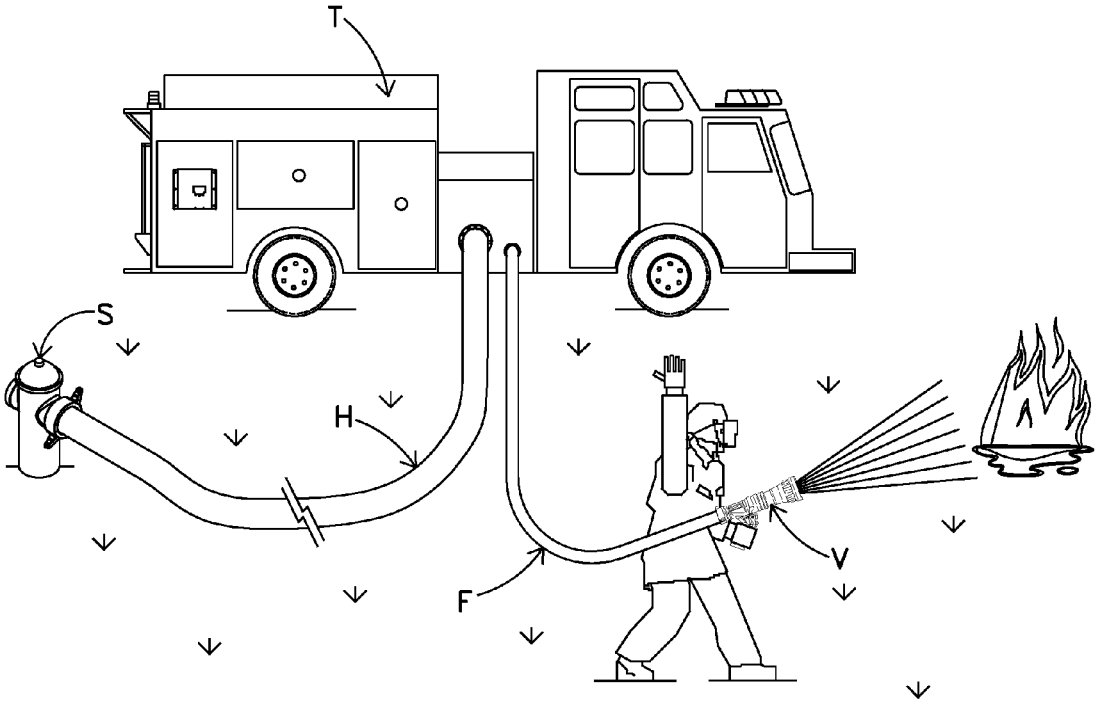
FIG. 1 is a simplified perspective view showing a trigger slide valve in use

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains.

In all of the drawings, the direction of flow is depicted as moving from left to the right. FIG. 1 shows a typical layout of a firefighter extinguishing a blaze using a trigger operated slide valve nozzle V. Water from a source such as a hydrant S is delivered by a supply hose H to a fire pump T which increases the pressure. Flow from the pump is delivered to the valve nozzle V using a fire hose F. The firefighter grasps the nozzle, operates the valve V, and directs water along a trajectory to extinguish the blaze, while restraining various forces. The nozzle depicted in FIG. 1 includes a trigger operated slide valve which is shown being operated by a firefighter using his first hand which is being used to restrain the nozzle as well as squeeze the trigger, while the second hand is being used to signal another firefighter. The second hand can also be used for many tasks such as gripping onto a vehicle to stabilize oneself while spraying liquid from a moving vehicle, to drag or reposition hose while changing positions within a burning structure, or to operate doors.

FIGS. 2A, 2B, 2C, and 2D depict four types of nozzle with a trigger operated slide valve. Each nozzle includes a shutoff valve and grip assembly extending below it operated by a trigger. Each grip assembly is securely mounted to a slide valve. Each slide valve has an inlet coupling on its inlet end to which a fire hose can be connected, and a nozzle front end on its outlet end from which water is discharged to the fire.

It can be seen that the same type of grip assembly can be used on many types of nozzles to meet the needs of Fire departments who have grown accustomed to choosing a variety of different nozzle types. For example two different sized valves are depicted allowing nozzles to be optimized to deliver larger flows as shown in FIGS. 2B and 2C, or with smaller flows as shown in FIGS. 2A and 2D.

Valve inlets are ideally designed for interchangeable installation to a family of inlet couplings allowing connection to fire hoses of various waterway diameters and hose connection types found around the world. For example 1" (25 mm) hose threaded couplings used in USA are depicted in FIGS. 2A and 2D, while a 2" (52 mm) Storz quick connector well known in Germany is depicted in FIG. 2B, and a 1.5" (38 mm) threaded coupling common to North America is shown in FIG. 2C.

Figure 2A:
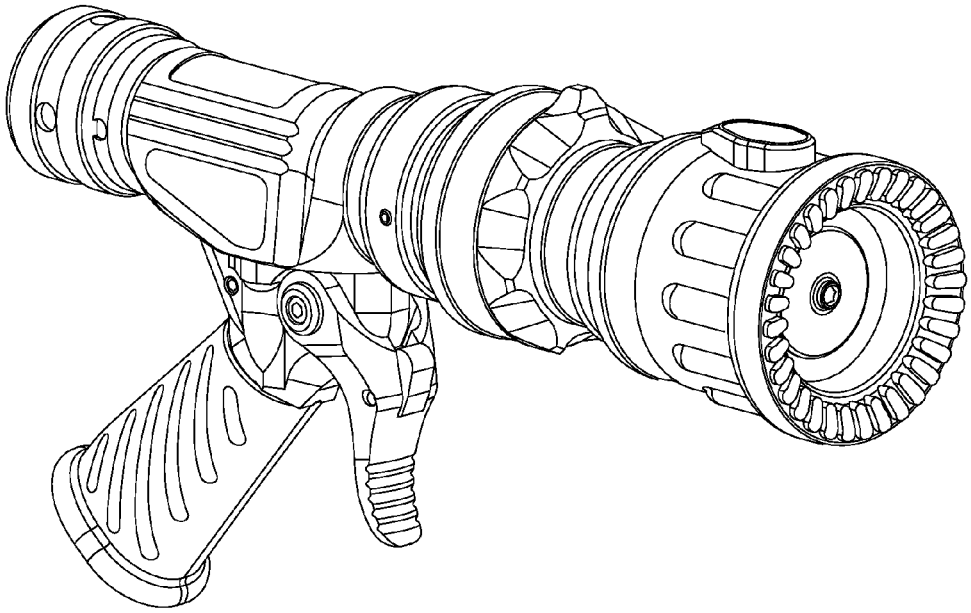
FIG. 2A thru 2D are external isometric views showing four nozzle configurations.
Figure 2B:
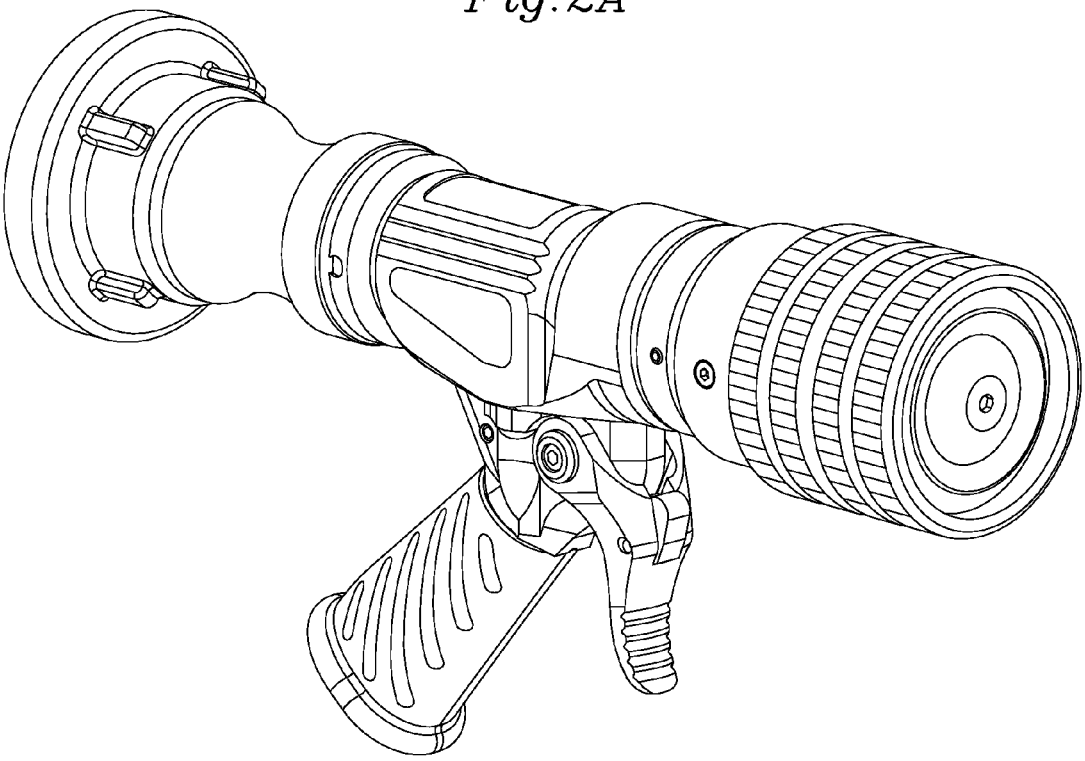
Figure 2C:
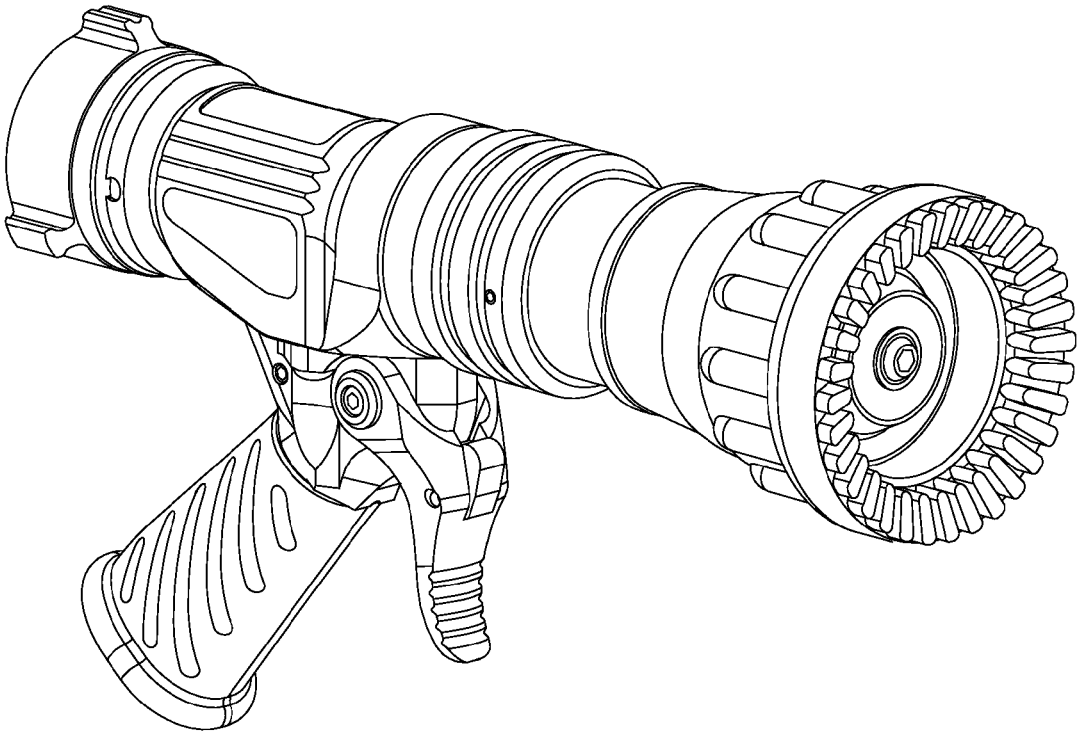
Figure 2D:
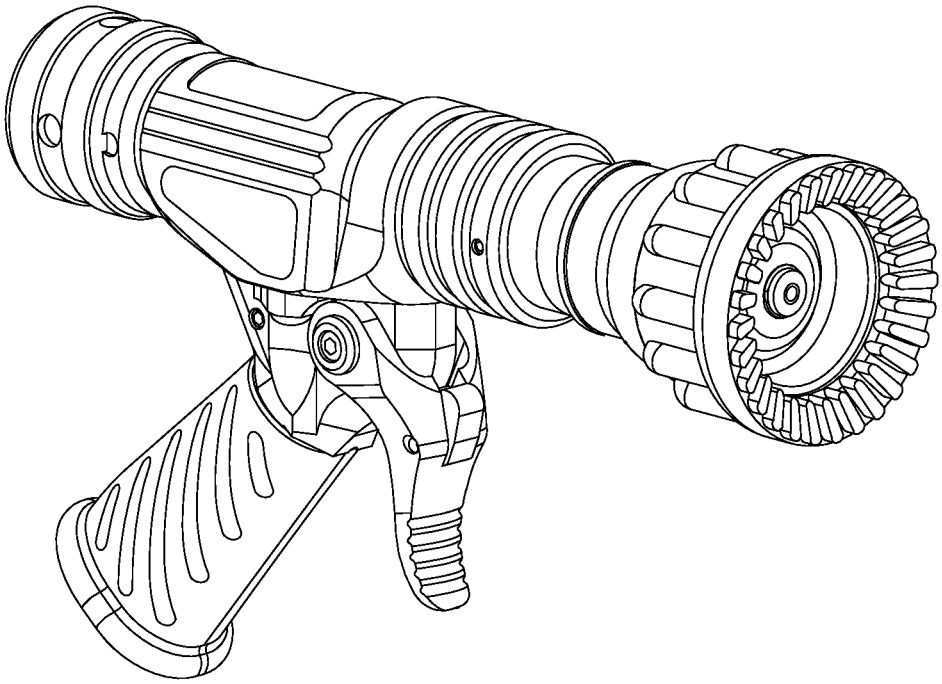

Furthermore, the front ends of the nozzle may include fixed orifice basic spray nozzles with a spray shape adjustable between straight stream and wide fog as shown in FIG. 2B, as well as more advanced nozzle designs allowing manual control of orifice size as shown in FIG. 2A. The nozzle front ends may also include a pressure controlling mechanism responsive to maintain velocity as shown in FIGS. 2C and 2D, or may be adapted to produce a firefighting foam from a solution of water mixed with foam using a foam aspirator, one type of which is depicted in FIG. 2B. Therefore, valve outlets constructed with a common connection to fit many nozzle front ends are preferred.

Figure 3:
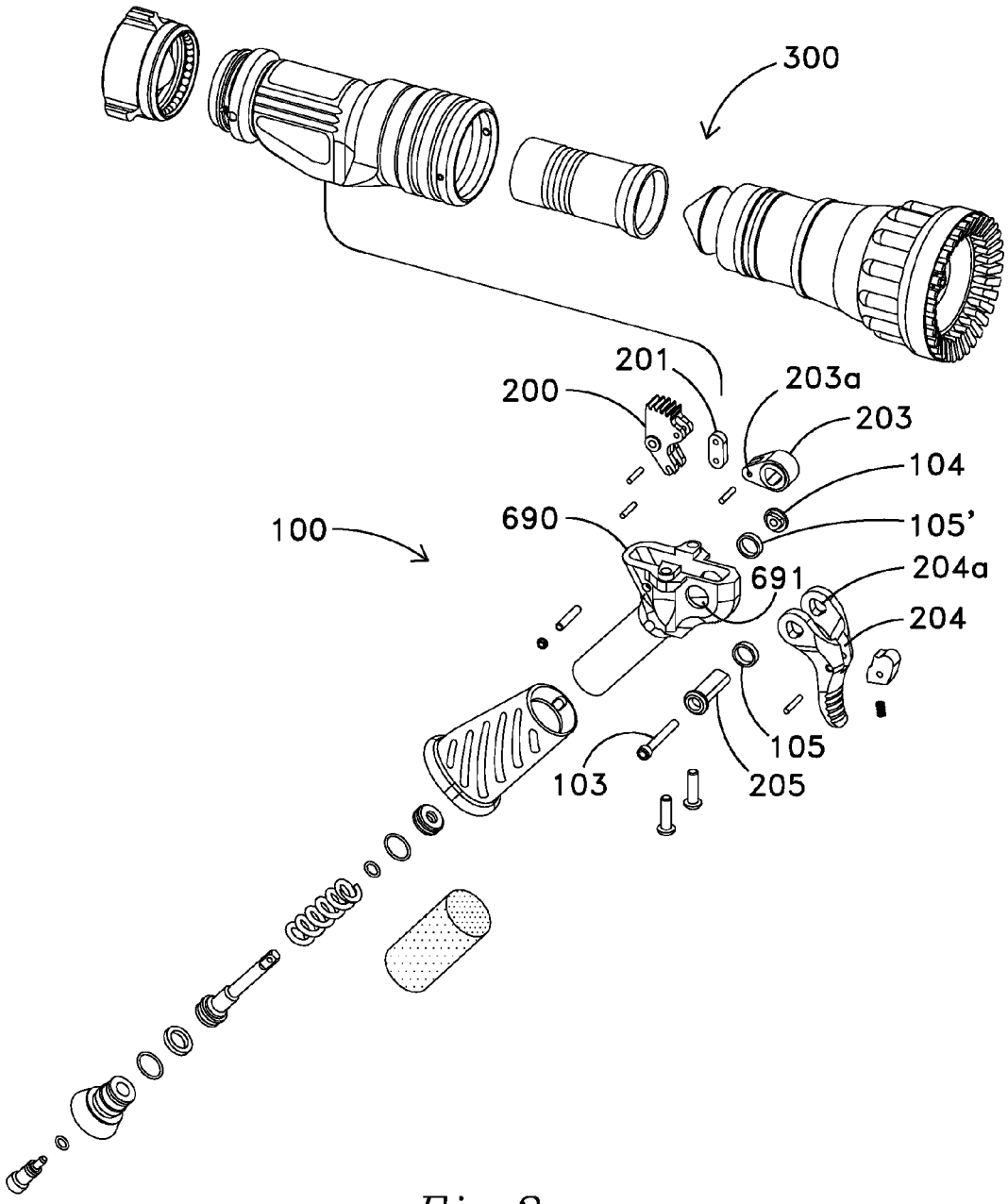
FIG. 3 is an exploded view on one of the nozzle configurations shown in FIG. 1.
Figure 5:
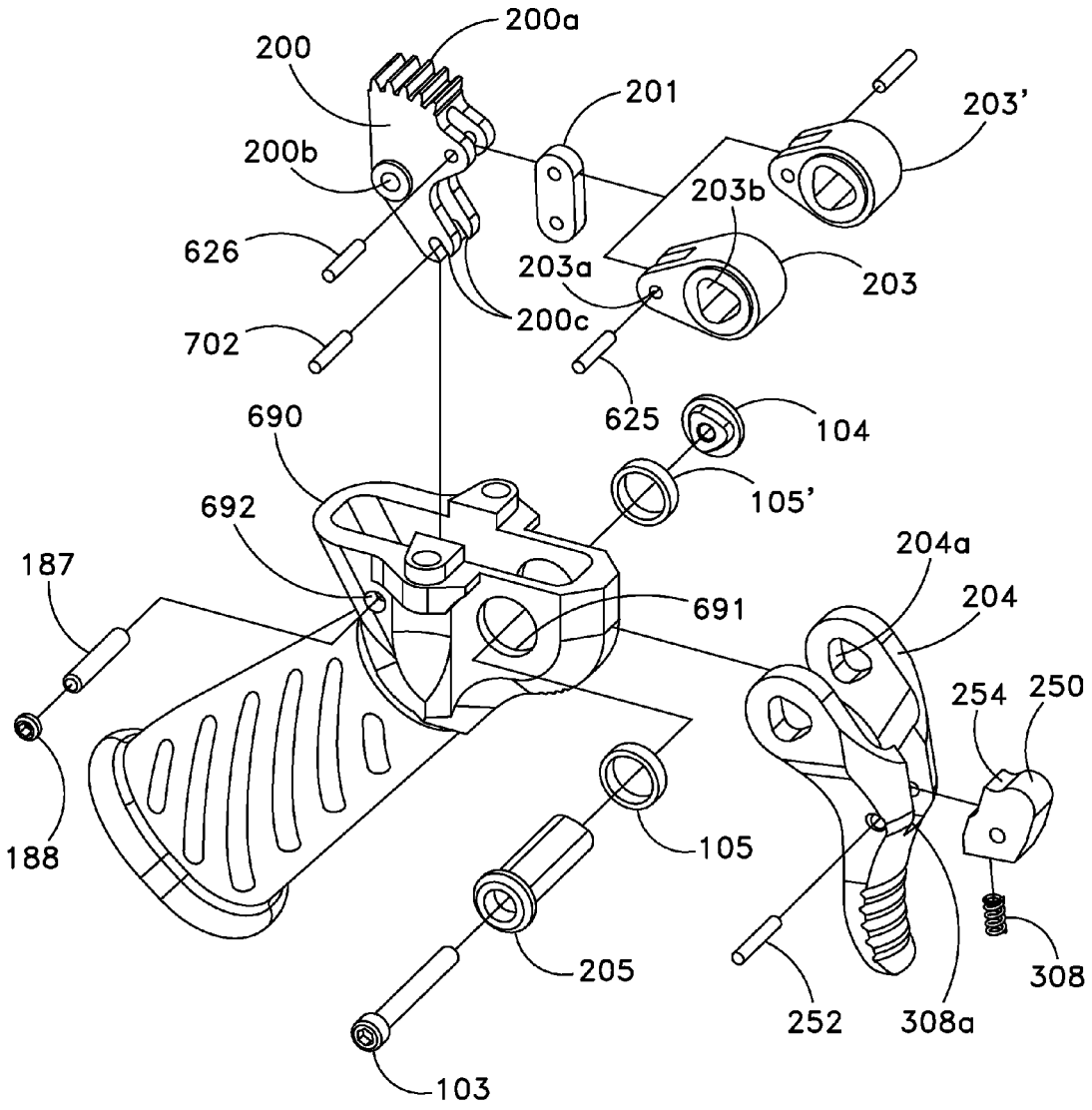
FIG. 5 is an exploded view of the trigger assemblies of FIG. 3 depicting components with variations in stroke lengths.

FIGS. 3 and 5 are partial exploded views of a trigger assembly 100 showing the components which drive the valve along its travel path to open and close the valve. The assembly is built on a main structural element called a pistol grip 690 which includes cross holes 691 forming a trigger pivot axis into which ride a screw, a lobed shaft 205, the trigger 204, a lever arm 203, and a retainer nut 104. A pair of spacers 105 and 105' space the components to prevent rubbing. The lever terminates in a tip hole 203*a* within the tip of the arm. Various lever arms 203 may be made with different lengths between the pivot axis 691 and the tip hole 203*a*, enabling arms of various lengths to be interchangeable on the valve, including a short length lever and a long length lever. Rotational motion of fingers gripping the trigger 204 is transmitted to the lobed shaft 205 by the conjugate lobed shape of the shaft opening 204*a* fitted there between. Rotation of the lobed shaft 205 is then transmitted to the lever arm 203 by the conjugate lobed shape of the opening 203*b* in the lever arm.

Figure 7A:
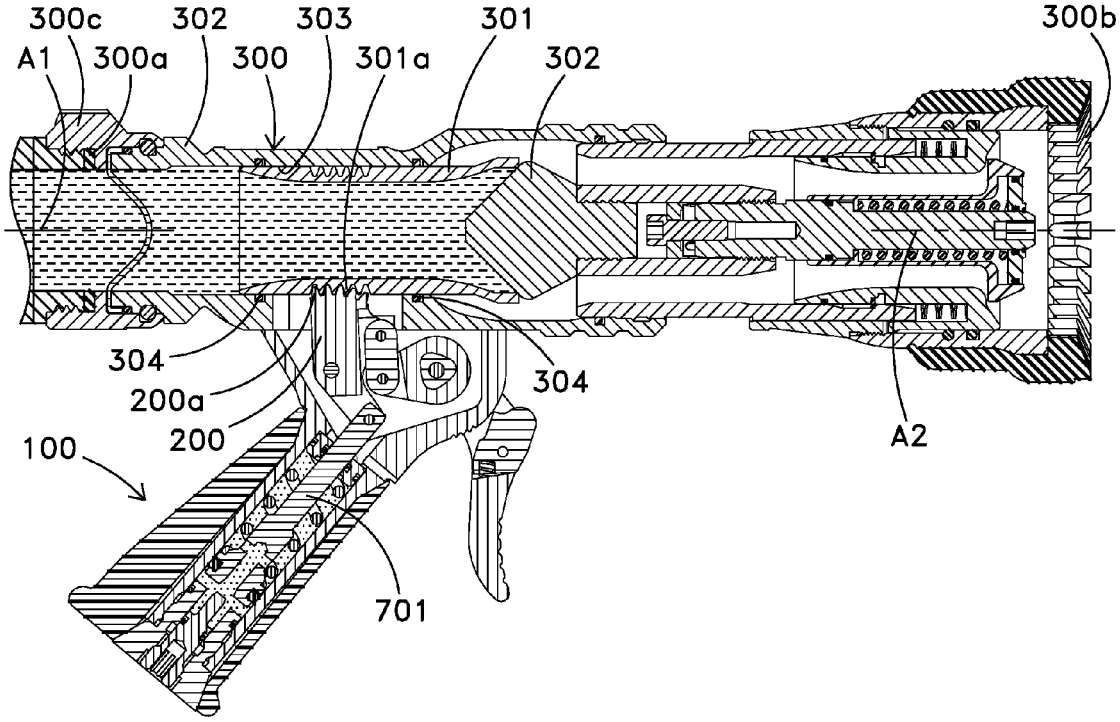
FIGS. 7A, 7B, and 7C are cross sectional view of FIG. 2 depicting the valve in the fully closed, partially open, and fully open positions respectively.
Figure 7B:
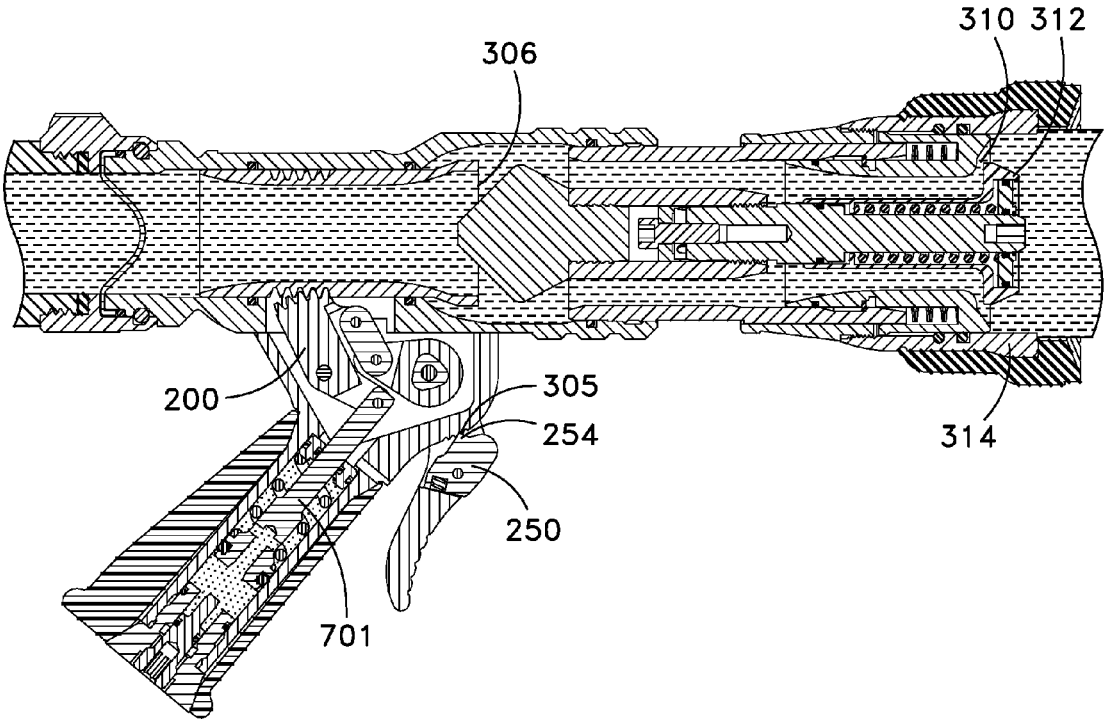
Figure 7C:
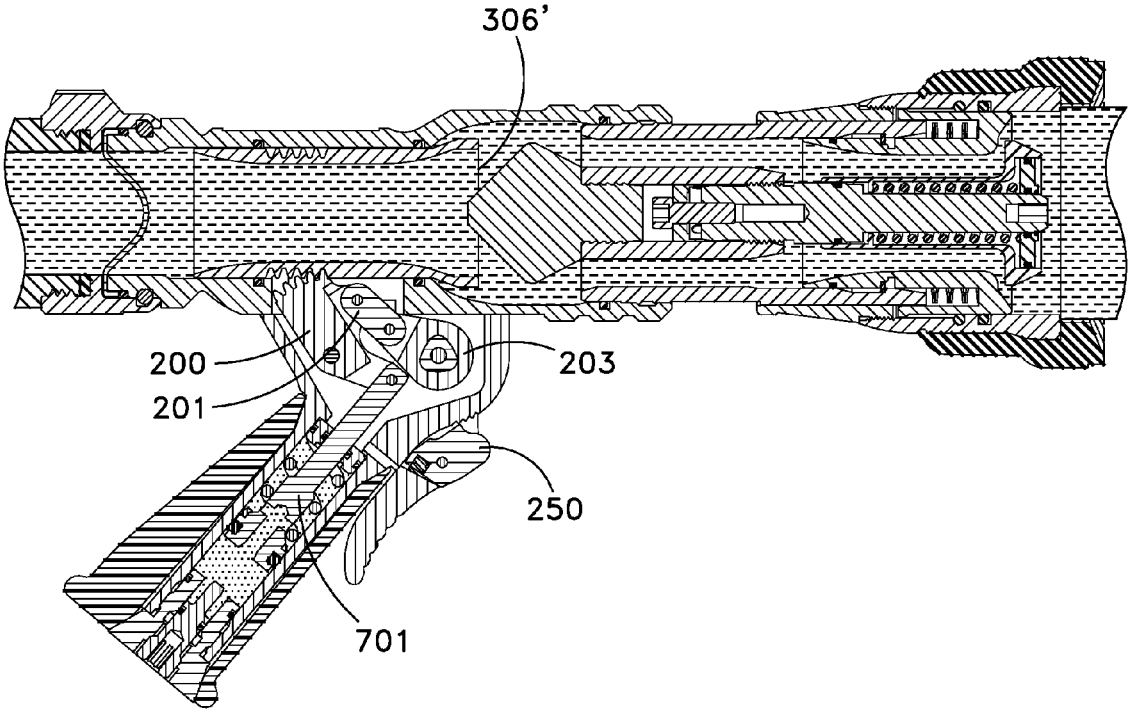

The lever arm 203 is connected to a segment gear 200 by a link 201, with one end of the link attached to the lever arm with a pin 625, and the opposite end of the link attached to the segment gear by a pin 626, each pin press fit into a corresponding bore in the lever arm and segment gear. The gear 200 has teeth 200*a* protruding from its upper portion which are arranged to be concentric about a pivot hole 200*b* defined in the gear. A gear pivot pin 187 engages a pivot hole 692 in the grip 690 and the pivot hole 200*b* in the gear 200 and can be retained with a set screw 188 along the gear's pivot axis. The gear teeth 200*a* engage mating teeth 301*a* on a valve element 301 disposed within a nozzle 300, as shown in FIGS. 7A-7C.

Figure 4:
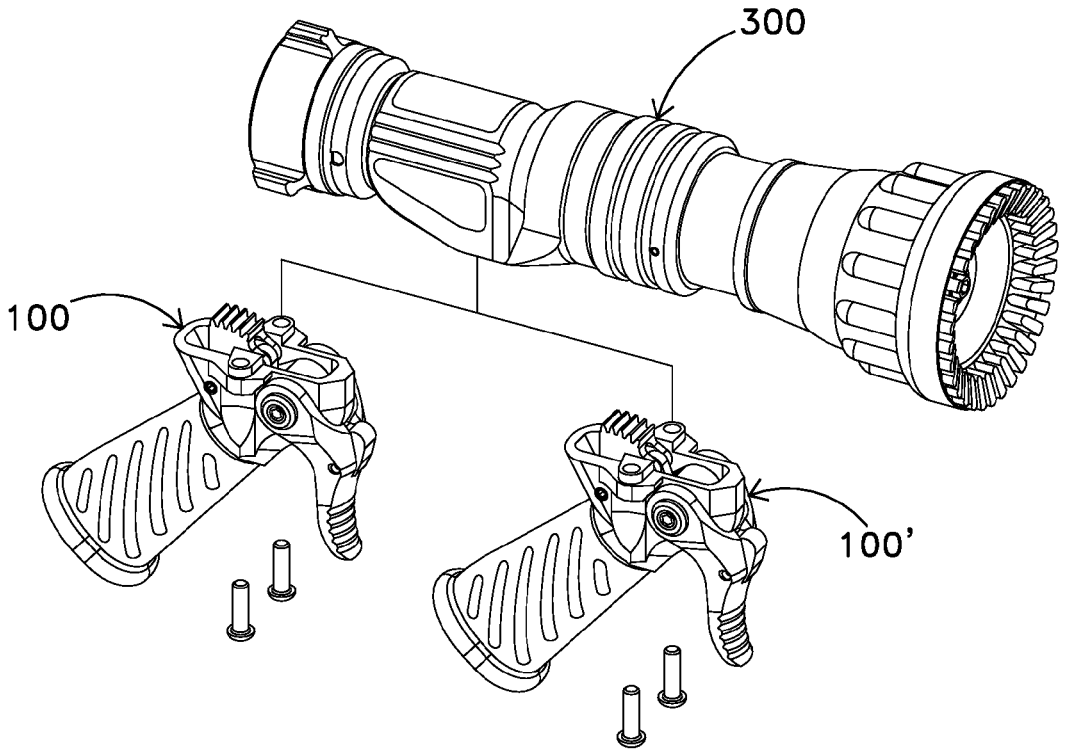
FIG. 4 is an external partial exploded view showing interchangeability of various trigger assemblies on a valve.

FIG. 4 shows trigger assemblies 100, 100' of FIG. 3 having different sized lever arms 203, 203' arranged for easy connection a nozzle assembly 300 in a manner similar to the nozzles shown in FIGS. 2A-2D. The maximum opening of the valve can be reduced to a lesser size by using a trigger grip assembly configured with a shorter stroke which is beneficial when operating on a high pressure pump so as to prevent excessive fluid from being discharged, and to increase the mechanical advantage of the trigger enabling it to overcome higher pressure without excessive grip force. Thus, the lever arm 203 has a greater distance between the pivot point 103 to the pivot connection 625 with the link 201, than for the lever arm 203'. The trigger assemblies 100, 100' are configured to be readily interchangeable for attachment to the nozzle 300. Thus, the grip assembly may be connected to the nozzle using fasteners such as screws.

FIG. 5 is an enlarged exploded view of the trigger assembly of FIG. 4 depicting linkage components or lever arms 203, 203' with different stroke lengths. Squeezing the trigger moves the lobed shaft 205 to rotate, which thus causes the lever arm 203 to rotate with the lobed shaft. Rotation of the lever arm causes the link 201 to pivot and translate, which then causes counterclockwise rotation of the gear segment 200. The teeth 200*a* of the gear segment engage the teeth 301*a* to move the valve element 301 between a closed position, as shown in FIG. 7A, and various open positions, as shown in FIGS. 7B-7C. The lever arm, link and gear segment thus act as a four-bar linkage to convert motion of the trigger as it is squeezed into translation of the valve element 301 to adjust the fluid flow through the nozzle assembly 300.

Figure 6A:
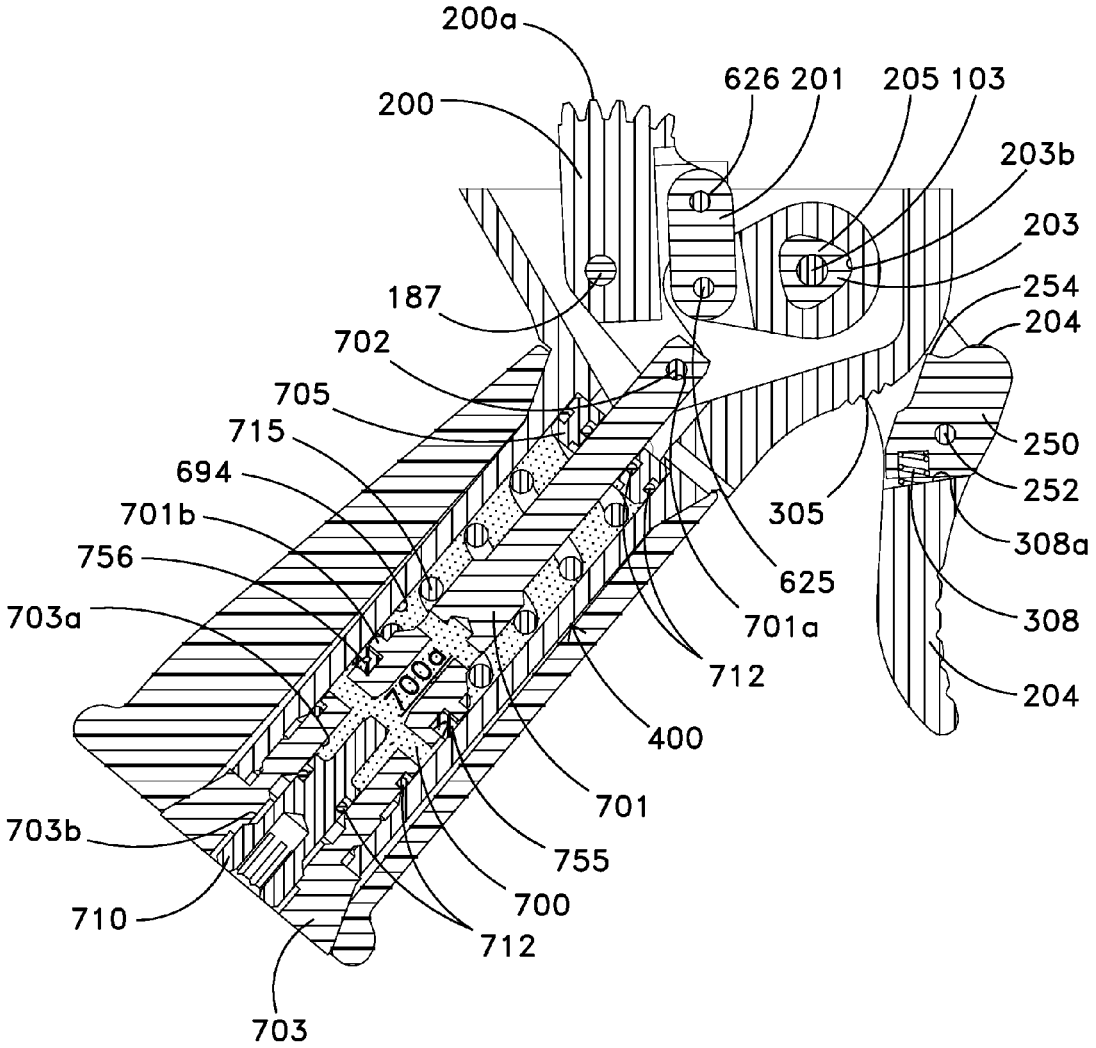
FIGS. 6A, 6B, and 6C are cross section views of FIG. 2 depicting adjustment positions of a dampening mechanism in its least dampened mode, partially dampened mode, and most dampened mode respectively.
Figure 6B:
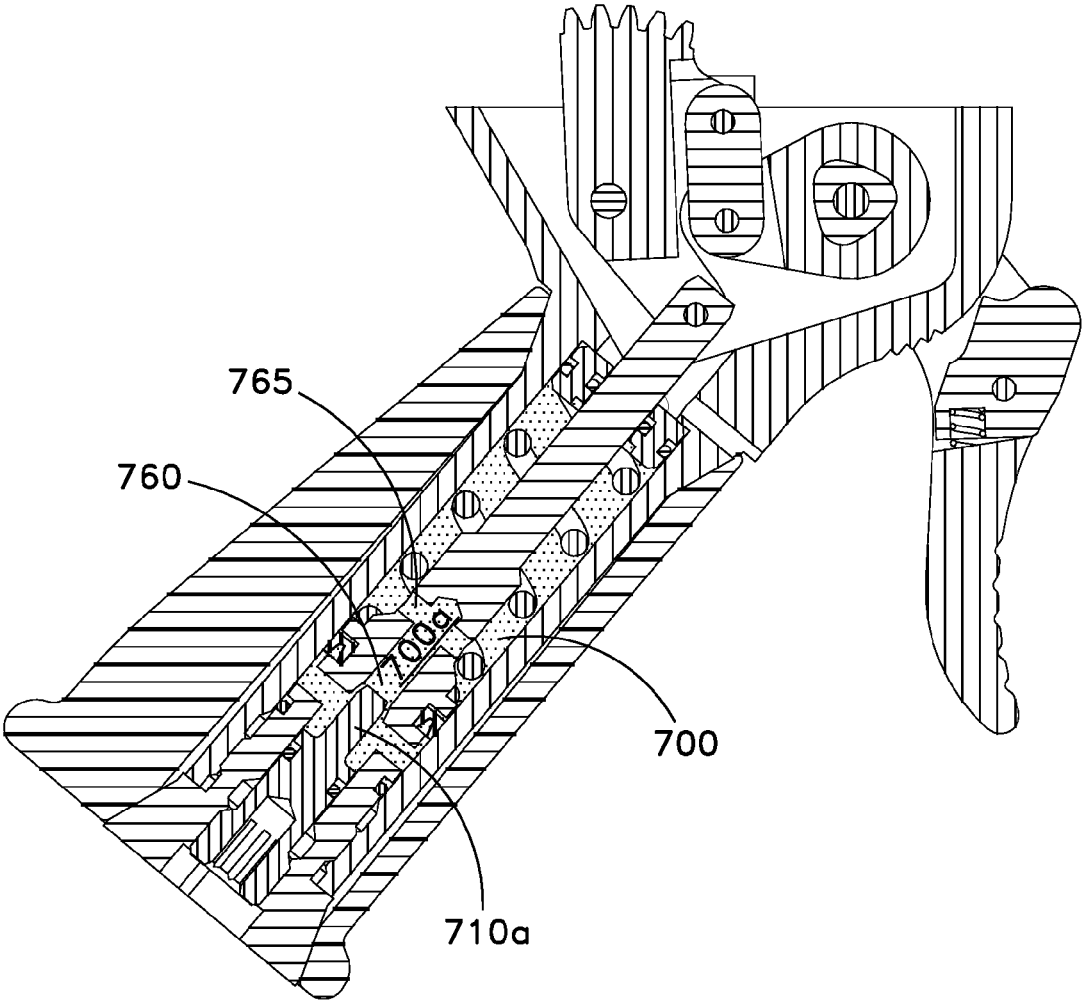
Figure 6C:
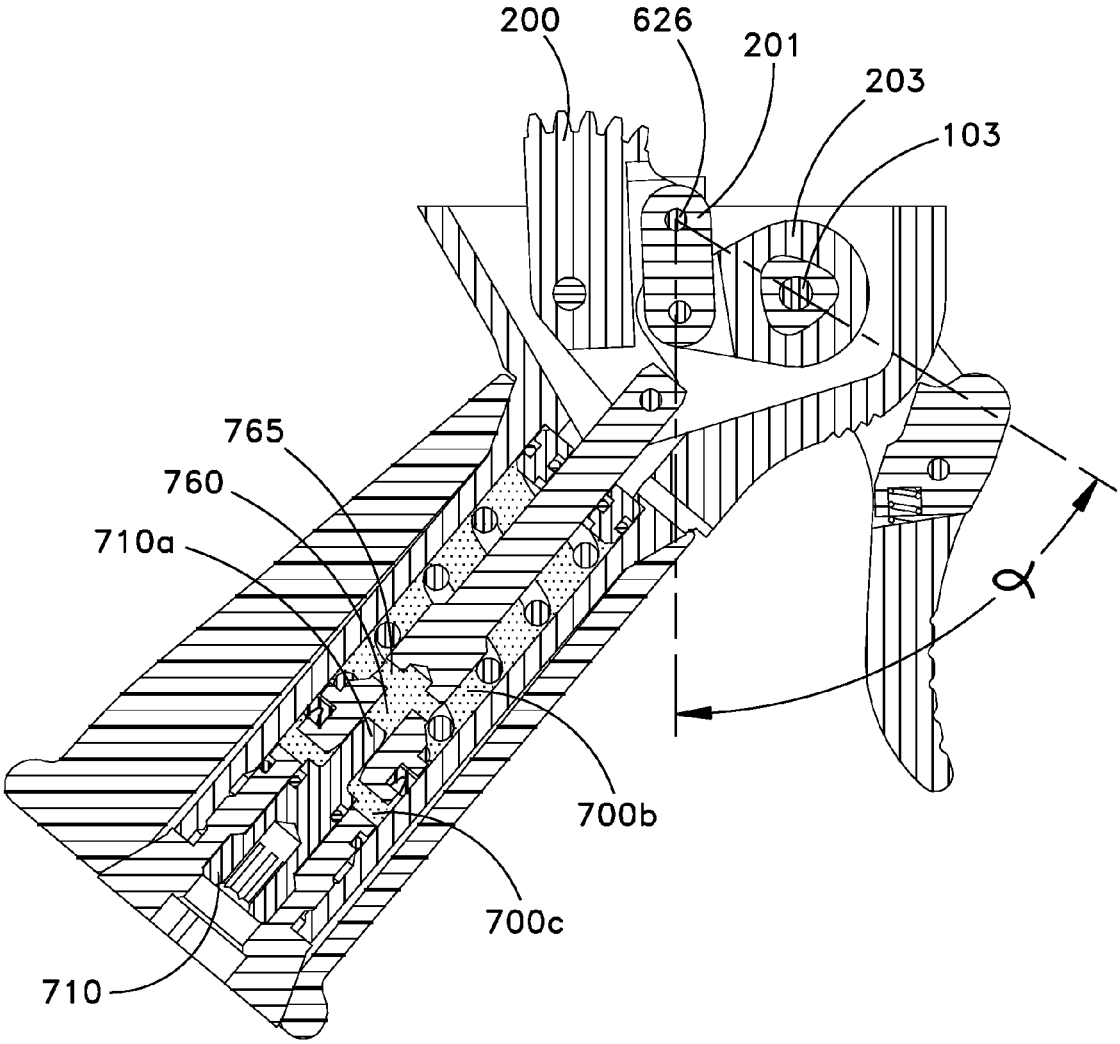

The four-bar linkage is constructed so that the link 201 is at an angle $\alpha$ relative to a line between the pivot point 103 for the lever arm 203 and the pivot point 626 between the link and the gear segment 200, as illustrated in FIG. 6C. As seen by comparing the position of the four-bar linkage among FIGS. 7A-7C, the angle $\alpha$ can be in the range of 40-60° in the closed position of FIG. 7A, to an angle $\alpha$ in the range of 0-20° in the fully open of FIG. 7C. In the fully open position of FIG. 7C, the axis of the link 201 is preferably as closely aligned with the line between pivot points 103-626 as possible without being exactly co-linear. A small angle $\alpha$ can dramatically increase the mechanical advantage provided by the four-bar linkage to allow the firefighter to easily hold the trigger in this full open position even under the extreme pressure exerted by the fluid flow through the nozzle. However, an angle $\alpha$ of exactly zero can limit or even inhibit the ability of the nozzle to rapidly return to a lower flow position when the trigger is released. In a specific embodiment the angle $\alpha$ is less than 10° in the full open position.

FIGS. 6A, 6B, and 6C are cross section views depicting a damping mechanism 400 associated with the trigger nozzle and the four-bar linkage used to control the valve component 301 (FIG. 7A). The damping mechanism 400 is shown adjusted between a minimum dampened mode (FIG. 6A), a partially dampened mode (FIG. 6B), and a maximum dampened mode (FIG. 6C). The dampening mechanism includes a dampening fluid 700, whose viscosity remains nearly constant over a wide range of temperatures. One preferred fluid is Dow Corning synthetic silicone dampening fluid. Rotation of the segment gear 200 causes axial motion of piston 701 because of engagement of pin 702 between piston push hole 701*a* and a pair of fork slots 200*c* (FIG. 5) on the end of the gear 200 opposite its teeth 200*a*. The slots 200*c* are long enough to maintain contact between the segment gear 200 and the pin 702 throughout the range of rotation of the gear as shown in FIGS. 7A-7C.

Axial motion of the piston is guided on the end nearest the piston push hole 701*a* by a guide 705, and on its opposite end 701*b* by a guide bore 694 within the pistol grip 690. The guide bore 694 also serves to locate the guide 705 coaxially with the guide bore and piston. Also fitted within the guide bore is a lower cap 703 which is threadedly engaged within the pistol grip 690. The lower cap 703 defines a cap guide bore 703*a* and internal threaded section 703*b* into which is screwed a speed adjuster 710. Dampening fluid 700 is retained in a dampening fluid zone 700*a* by appropriately-sized O-ring seals 712 at four locations; on the interior and exterior of the guide 705, on the exterior of the cap 703 and on the exterior of the adjuster 710.

Also disposed in the dampening fluid zone is a compression spring 715 which is positioned to urge the piston 701 toward the lower cap 703 to bias the valve to its closed position. A cup seal 755 is disposed in a groove 756 defined in the circumference of the larger end 701*b* of the piston and is engaged to slide within the guide bore 694. The piston includes an axial fluid passage hole 760 and a traverse fluid passage hole 765 (FIG. 6C).

The dampening fluid zone 700*a* is divided into two chambers 700*b* and 700*c* (FIG. 6C). A spring fluid zone chamber 700*b* is defined as the region surrounding the spring 715, bounded by the guide bore 694, the guide 705, and the portions of the piston proximate the spring. An adjuster fluid zone chamber 700*c* includes the region bounded by the adjuster 710, the end of the lower cap 703 nearest the piston, and the large end 701*b* of the piston. FIGS. 6B-C show the relationship of the trigger grip assembly while the valve is in a closed position which corresponds to minimum fluid volume of the adjuster zone chamber 700*c*, and maximum fluid volume of the spring chamber 700*b*.

As the nozzle's valve is opened to discharge water to the fire, dampening fluid can move between the chambers by either forcing it through the fluid passage holes 760, 765 past the small end of the adjuster 710, or past the cup seal 755 which can only restrain significant dampening fluid pressure in one direction owing to the direction in which it is installed. The cross section of the cup seal is V-shaped and is installed with the opening of the V nearest the cap 703, while the vertex of the V is nearest the guide 705. In this way the cup seal 755 not only acts as a check valve, but also adds negligible friction to the opening stroke.

As the nozzle's valve is closed, the cup seal 755 is energized by fluid pressure, so motion of the piston 701 towards the cap 703 must empty fluid out of the adjuster chamber 700*c* by flowing back into the spring chamber 700*b* thru the fluid passage holes 760, 765.

If the tip of the adjuster is adjusted along its length to the adjuster position shown in FIG. 6A then fluid is free to pass between chambers in both directions without restriction of the adjuster, thus the valve will close at maximum speed—i.e., with minimal dampening. If the adjuster is threaded inwards to the position depicted in FIG. 6C then fluid must pass between a small gap defined by the annulus existing between the internal diameter of the axial fluid passageway 760 and the outside diameter of the adjuster tip 710*a*. In this adjustment position, the entire closing stroke has been dampened, and the valve will close slower over its entire stroke from full-open to full-closed. If the adjuster is set to some midway position then dampening over a portion of the stroke may be obtained by selecting the desired adjuster position. The position depicted in FIG. 6B shows the adjuster tip 710*a* just entering the axial fluid passageway 760 as the valve 301 comes to its fully closed position (FIG. 7A).

Dampening is desirable from two standpoints—it reduces the water hammer in the hose caused by decelerating the mass of water in the fire hose, and it reduces the rate of change of nozzle reaction caused by the nozzle's acceleration of water discharged toward the fire. Abrupt changes in flow can cause the fire hose F to "jump" a few inches as the hose becomes stiffened and lengthened by pressure increase and from transient shock waves caused by water hammer. The combination of these two effects on the firefighter's hands, arms, back, and joints, can be loosely equated to the effect of being kicked by a kick boxer.

More dampening is generally desirable to lessen water hammer in the hose when using fire hoses capable of higher flows because the mass of water times it's velocity in the hose has a larger kinetic energy than with smaller flows. More dampening is also desirable as pump pressures become higher because higher pressures tend to increase flow as well as nozzle pressure, thereby increasing nozzle reaction force. More dampening may be needed when operating temperatures are higher to compensate for the viscosity reduction of the dampening fluid, or to compensate for poor footing in slippery conditions.

On the other hand, too much dampening inhibits the desire to rapidly pulse the water on and off for flashover pulsing. Too much dampening can also decrease safety by increasing the length of time an unrestrained nozzle can flow before shutting itself off thus coming to rest. The adjuster 710 which can be adjusted to dampen only the desired portion of the stroke enables ergonomic selection of the most suitable dampening. It is contemplated that the volume 700*a* may include some air to compensate for volumetric variations due to temperature fluctuations.

Figure 6D:
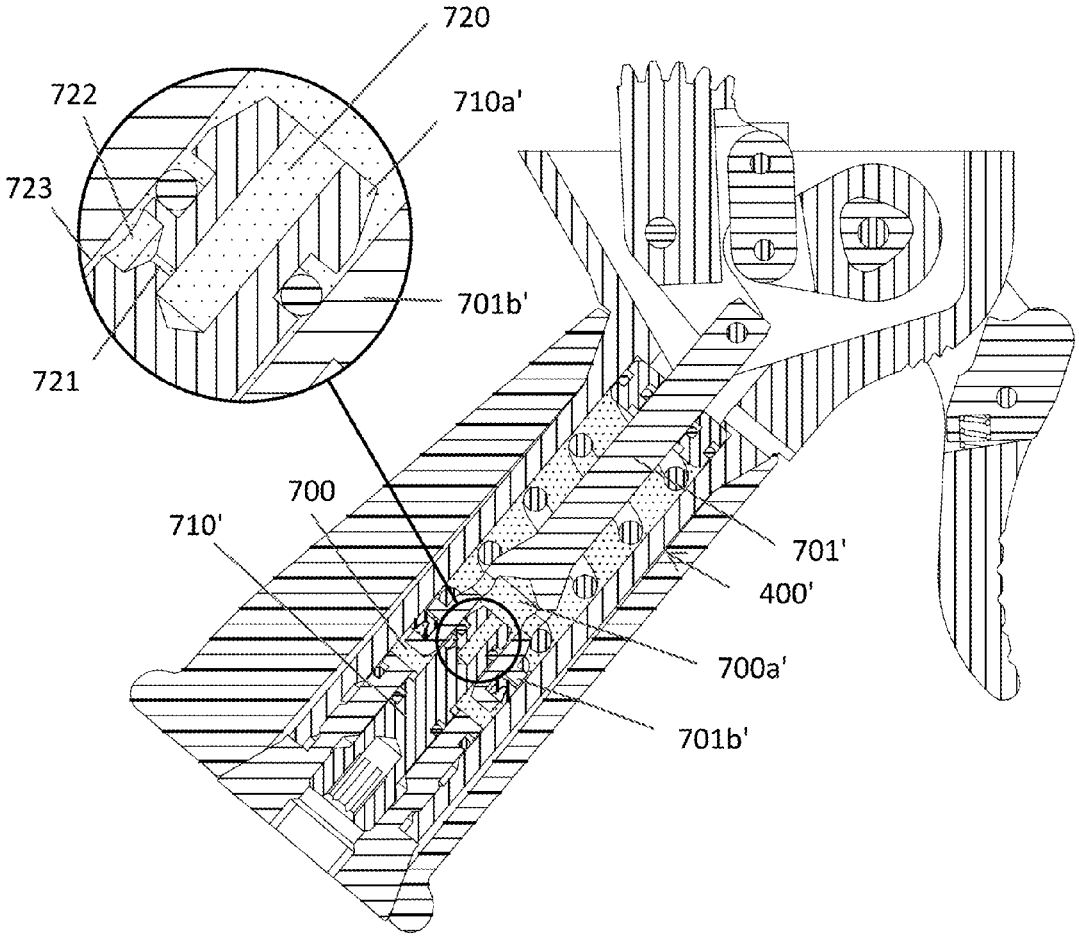
FIG. 6D is a cross section view of a modified dampening mechanism in is most dampened mode.

A modified dampening mechanism 400' is shown in FIG. 6D that is similar in construction to the dampening mechanism 400 but with some modifications to the piston 701' and the speed adjuster 710'. In particular, the opposite end 701*b*' of the piston 701' is provided with a large dampening fluid zone bore 700*a*', as shown in FIG. 6D. The adjustment tip 710*a*' of the speed adjuster 710' extends into the bore 700*a*' to control dampening fluid flow through the bore. The adjuster tip 710*a*' defines a central bore 720 that communicates with a side outlet 722 by way of a narrow cross bore 721. As shown in the detail view in FIG. 6D, the outer diameter of the adjuster tip 710*a*' is sized to leave a flow gap 723 between the tip and the piston end 701*b*' so that a small amount of dampening fluid is always in communication between the dampening fluid zone 700*a*' and the main bore 700. The size of the cross bore 721 controls the rate of flow of this collateral dampening fluid to thereby provide incremental velocity control of the dampening mechanism 400'. Different speed adjusters 710' may be provided with different cross bore diameters to achieve specific velocity profiles.

FIGS. 7A, 7B and 7C are cross section views of the nozzle of FIG. 2C depicting the valve in the fully closed, partially open, and fully open positions, respectively. Referring now to FIG. 7A, water from the fire hose enters the nozzle 300 through inlet opening 300*a*, and a coupling 300*c* adapted to couple to a source of fluid, such as a fire hose. The water flows through the valve body and slider 301 to the outlet opening 300*b*. As depicted in FIG. 7A, the inlet opening 300*a* and the outlet opening 300*c* each define a corresponding flow axis A1, A2. In one aspect of the present disclosure, the two flow axes A1, A2 are substantially parallel and in one specific embodiment are substantially collinear. This is in contrast to the conventional firefighting trigger nozzles in which the water inlet is transverse to the water outlet.

The trigger assembly 100 is mounted to barrel of the nozzle 300 at a non-parallel and non-collinear orientation relative to the flow axes A1, A2. In particular, the trigger assembly is mounted so that the pistol grip 690 projects downward from the barrel, as shown in FIG. 7A. This allows the firefighter to grasp the trigger assembly in a comfortable and ergonomically effective orientation.

The slider 301 in the closed position abuts axially against a valve plug 302 which forms a sealing surface against the slider at the point of contact. The interior surface of the slider is entirely wetted with water, whereas the exterior surface of the slider is fitted within the valve body 302 to move axially along engagement with a mating valve bore 303. A pair of slider O-ring seals 304 of equal diameter seal water from leakage around the exterior of the slider. Additional seals at the inlet coupling, hose connection, and at the connection between the valve body and the nozzle's front end maintain liquid within its flow path.

Considering the motion of the slider by itself (i.e., without the effect of the trigger grip assembly), if the diameter of the point of contact of the slider 301 with the valve plug 302 is identical to the diameter of the slider O-ring 304 nearest the coupling, then fluid pressure does not impart axial force on the slider because the net area in the axial direction is zero. Therefore even under high pressure the slider can be moved towards its open position by merely overcoming slider seal friction.

Axial motion of the slider 301 is imparted by the trigger grip assembly 100 by engagement between the segment gear teeth 200*a* and conjugate rack teeth 301*a* formed into the outside of the slider 301. The valve will open if the trigger 204 is squeezed creating a conical valve opening annulus 306 (FIG. 7B) between the slider 301 and the valve plug 302 at what had been their sealing point. Fluid from the opening continues into the front end of the nozzle 300 until a point at which its velocity is increased by the discharge orifice 310 which is the minimum flow area. The orifice of FIG. 7B occurs as water pressure acts against a spring mechanism 312. Water discharged past the orifice may be shaped into a straight jet by a shaper 314 as shown, or may be discharged as a conical spray of various angles as the shaper is partially or fully retracted according to common practice.

The trigger 204 may be depressed further to open the valve fully to the position depicted in FIG. 7C which moves the slider 301 further towards the coupling and away from the valve plug 302, thus creating a larger conical valve opening annulus 306', and the maximum flow. Dynamic forces of water flowing through the slider produce an axial force tending to close the valve as a result of frictional drag through the slider. The piston spring 715 of the damper assembly 400 also creates a force increasing the valve's tendency to close. These forces are larger than can be resisted by finger squeeze alone, thus the relative position and orientation of the 4-bar linkage in this position are used to overcome the forces as the link 201 and the arm 203 come into near alignment, as shown in FIG. 7C, forming a nearly self-locking four-bar linkage. In this way, near zero force is needed to retain the valve in the fully open position.

At times it is desirable to hold the valve 300 at a set position for an extended length of time. Therefore a lock lever 250 is positioned on the trigger 204 on a lock lever pivot 252, as shown in FIGS. 5 and 6A. The lock lever 250 includes a detent 254 that can be urged into locking engagement with serrations 305 on the pistol grip 690 by merely pressing a finger against the lock as the valve is opened, and then releasing the trigger to retain a locked position. Thus, as shown in FIGS. 7B-7C, the lock lever 250 can be locked at different positions relative to the pistol grip, with the positions corresponding to configurations of the 4-bar linkage, and ultimately positions at which the valve 301 is locked. It can be appreciated that partially squeezing the trigger or even dropping the nozzle is enough to release the lock lever 250 from engagement with a serration 305 due to urging of a lock compression spring 308 that bears against a surface 308*a* of the trigger 204. As seen in FIG. 6A, the spring 308 is oriented relative to the pivot 252 to provide a force that pushes the detent 254 up and away from the serrations 305.

Figure 8:
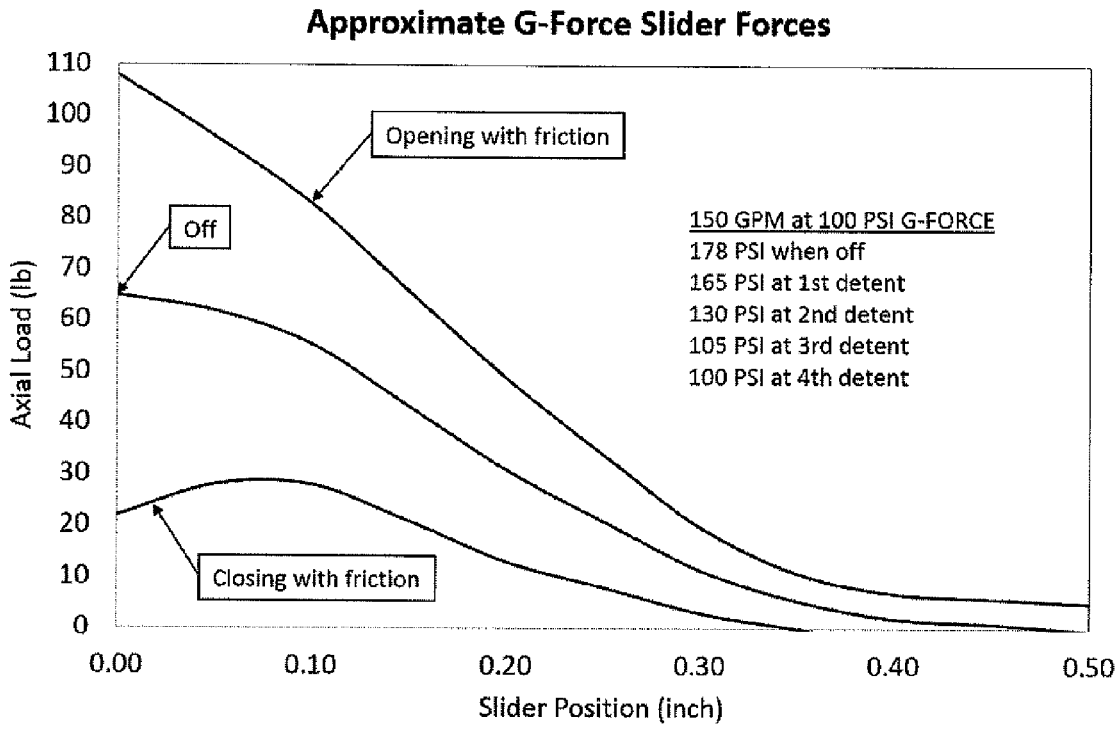
FIG. 8 is a graph of axial load on slider versus slider position.

FIG. 8 is a graph showing the axial forces acting on a slider of a lever operated slide valve nozzle commercially sold by task Force Tips, Inc., under the trademark G-Force™. This valve size is identical to that of the large trigger valve size depicted in FIGS. 2B and 2C. The G-Force™ lever type valve has detents on the lever to retain the slider at various set positions under the axial forces of water flow and pressure. The slider of this type has a substantial positive net area difference between the O-ring seals, and the slider's point of contact resulting in a positive axial load force towards the closed position, and near zero axial force at the maximum slider position, which corresponds to the valve's opening. A slider position of zero is the closed position, while moving it fully results in nearly a half inch of travel. An opening force of over 100 pounds is needed to move the slider, so it can be seen that using grip force alone without mechanical advantage is unlikely to result in a trigger valve which is easy to use. On the other hand, the force needed to close the valve once fully opened is less than zero, indicating a trigger valve which would remain stuck in the open position.

Figure 9:
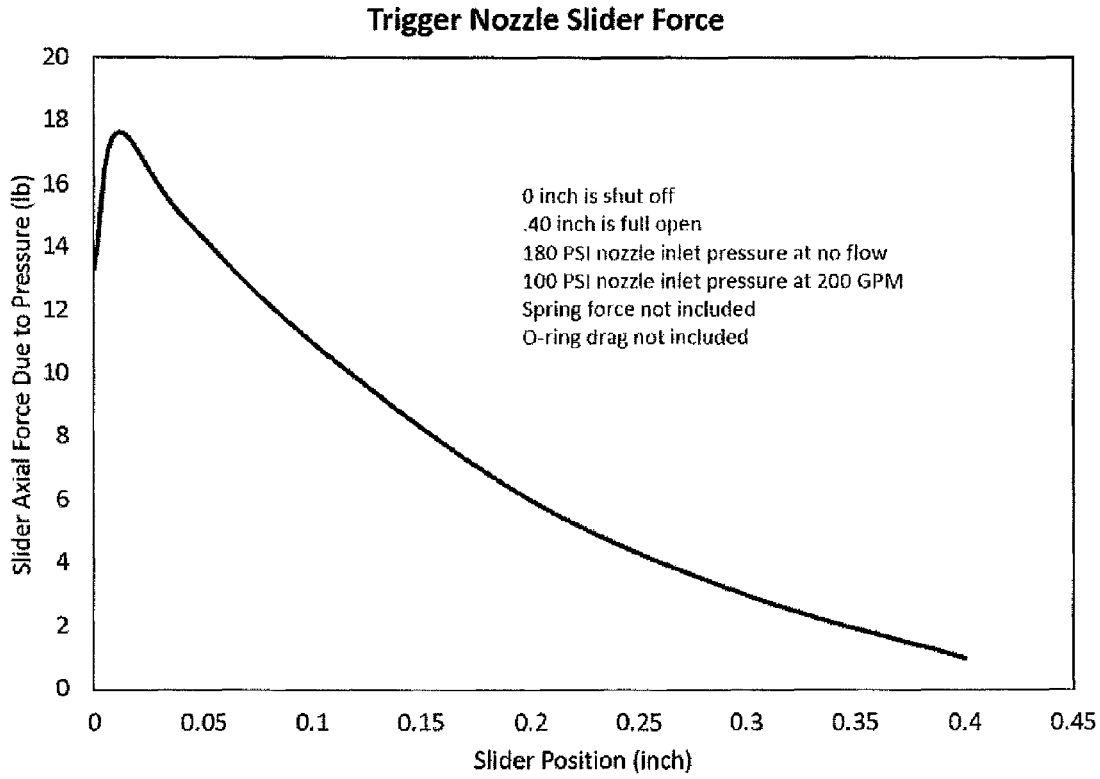
FIG. 9 is a graph of axial forces due to water pressure at various slider positions.

FIG. 9 is the corresponding graph for a trigger operated slide valve according to the present disclosure. The forces acting on the slider are substantially less owing to the substantially less positive active area on the slider. The valve plug is preferentially made from ultra-high molecular weight polyethylene which has good abrasion resistant and sealing abilities. As flow commences the slider moves back slightly and the force on the slider increases as a result of fluid velocity increasing along the face of the slider in regions formerly in sealing contact with the valve plug according to the Bernoulli effect which is to say pressure (thus force) decreases where velocity increases. Hydrodynamic force on the slider in the full open position is near zero in the fully open position.

Figure 10:
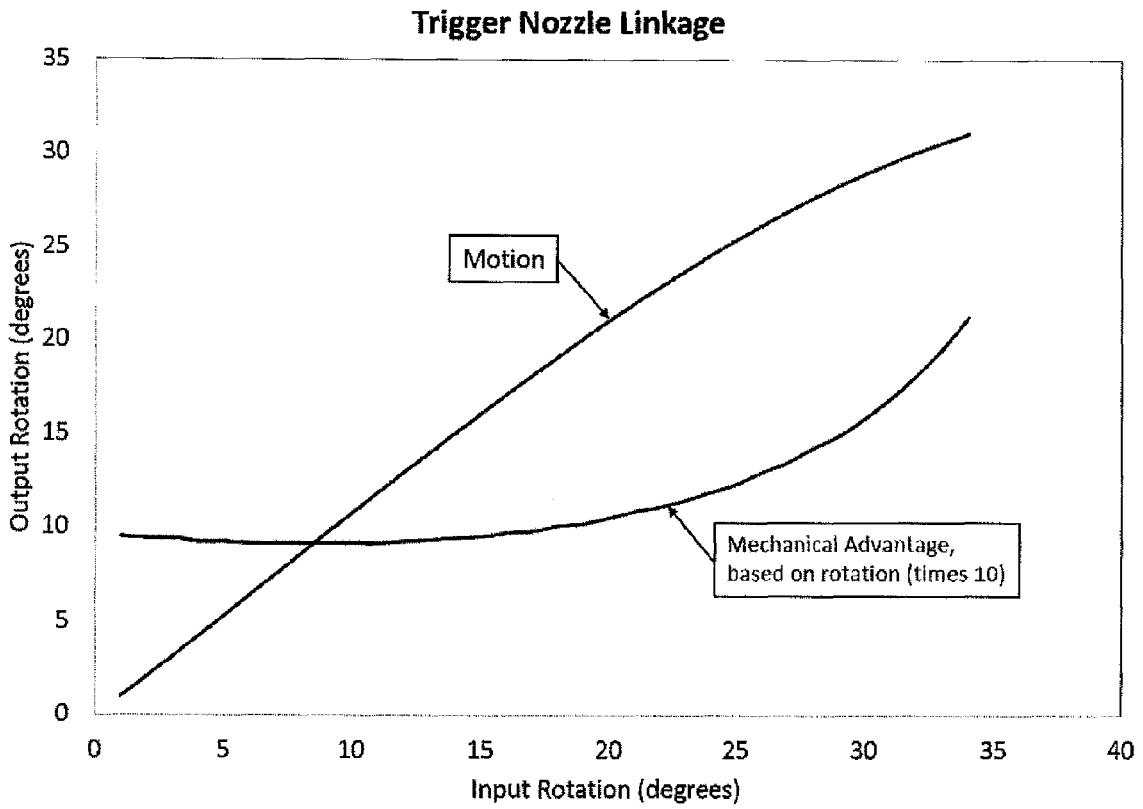
FIG. 10 is a graph which characterizes mechanical advantage.

FIG. 10 depicts the kinematics of a trigger valve linkage mechanism according to the present disclosure. The curve labeled "Motion" denotes how input motion from squeezing the trigger will produce a clockwise rotation of about 35 degrees, resulting in a counterclockwise rotational output to the segment gear of about 30 degrees. The other curve denotes how mechanical advantage of the trigger (times ten) increases radically as the trigger moves the valve towards it's fully opened position. The 4-bar linkage of the present disclosure gives the firefighter's fingers more mechanical advantage to retain a fully opened slider position against the higher forces of the fully compressed spring and the hydrodynamic force at maximum fluid velocity tending to drag the valve closed, without being so near a self-locking four-bar linkage position as to risk the linkage becoming stuck in the full on position. Self-locking occurs when the pivot pin joining the arm to the link is in alignment with both the trigger pivot axis and the pivot pin joining the link to the segment gear, as angle $\alpha$ is equal to or less than zero (FIG. 6).

Figure 11A:
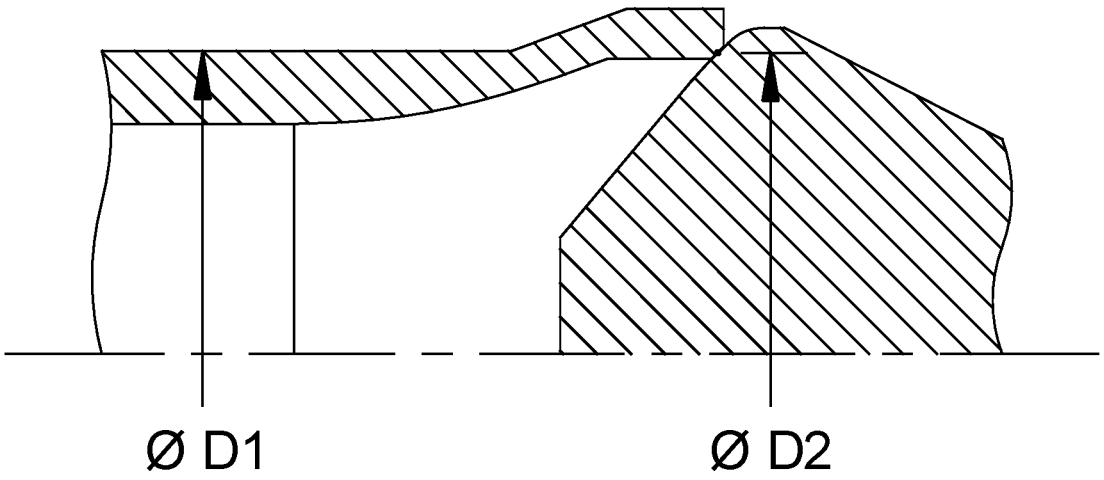
FIGS. 11A and 11B depict diameters influential to the axial forces of water on the slider.
Figure 11B:
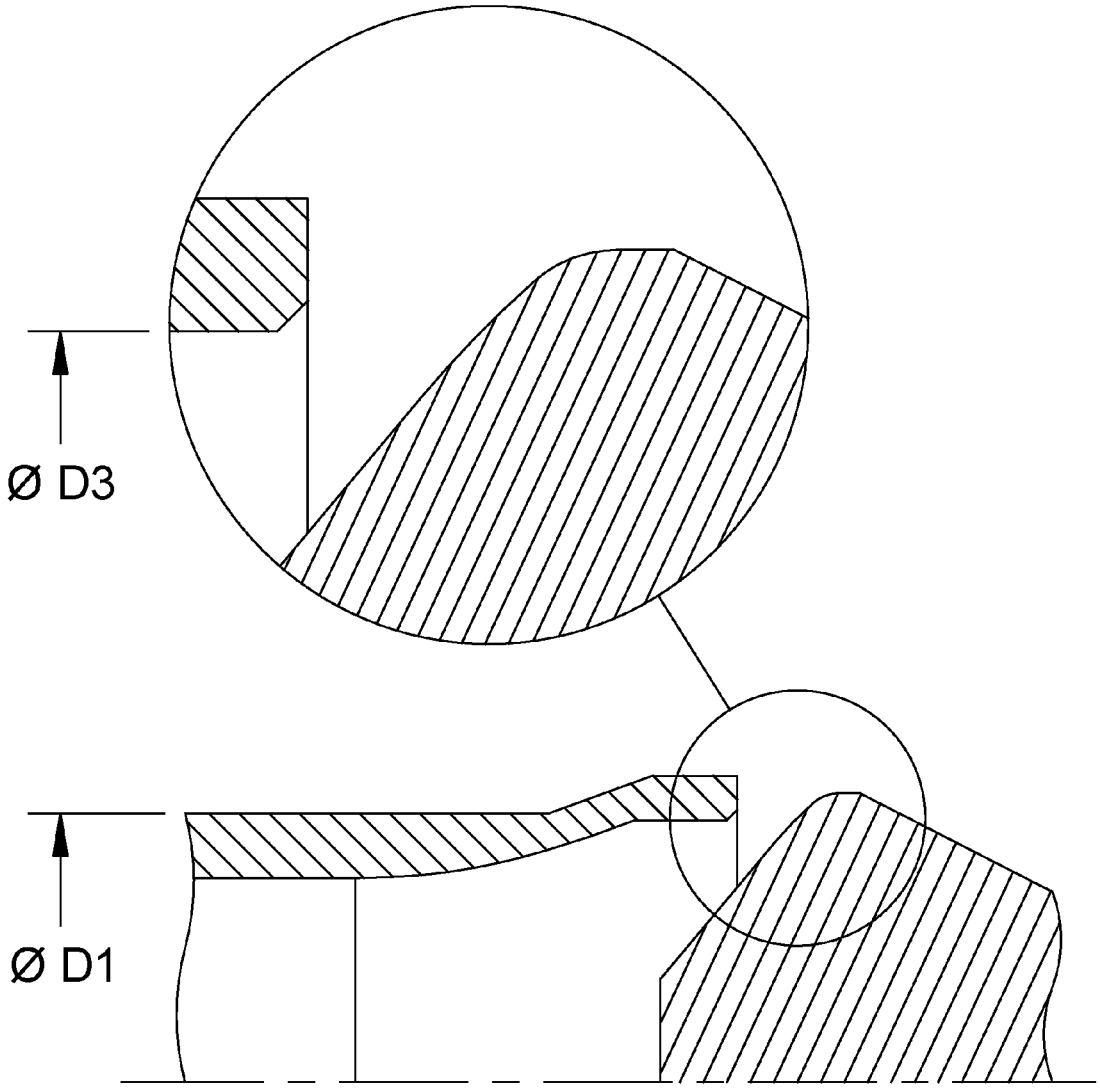

FIGS. 11A and 11B show the preferred diameters and active areas of a trigger operated slide valve rated for flows up to 200 GPM (760 L/min). Water pressure causes an axial force on the slider in the closed position because O-ring sealing diameter D1 is larger than valve seat contact diameter D2. This surface projected area on the preferred slider is about 0.074 square inches, which causes about 15 pounds force (6 kg) at 200 PSI (14 bar) in the closing direction of the nozzle. The preferred spring force from the trigger grip assembly contributes an additional 3 pounds axial force (1.4 kg) to the slider in the closing direction.

In the partially open position shown in FIG. 11B, high velocity water passes across the end of the slider, thus axial force of water on the slider tend to be dominated by the difference in area between diameters D1 and D3, and frictional drag along the inside of the slider's waterway.

By ratio and proportion it is believed that the fire-fighting nozzle and valve of the present invention can be scaled up to include larger valves capable of flows in the range considered manageable for firefighting with hand-held nozzles, without exceeding reasonable limitations of finger squeeze.

The present disclosure should be considered as illustrative and not restrictive in character. It is understood that only certain embodiments have been presented and that all changes, modifications and further applications that come within the spirit of the disclosure are desired to be protected.

What is claimed is:

1. A firefighting nozzle comprising:

an elongated barrel having a inlet opening at one end for engaging a source of fluid under pressure and a discharge opening at an opposite end for engaging a discharge element for dispensing the fluid under pressure;

a valve arrangement disposed within said barrel between said inlet opening and said discharge opening, said valve arrangement configured to adjust the flow of fluid through the barrel and including a slide valve element slidably mounted within the barrel for reciprocating movement along the length of the barrel, the slide valve element including a toothed surface;

a trigger assembly mounted on the barrel and including;

a trigger housing coupled to said barrel and defining a pistol grip for manual grasping during operation of the firefighting nozzle;

a segment gear pivotably mounted within said trigger housing and including at least one tooth for engaging the toothed surface of said slide valve element so that rotation of said segment gear causes the at least one tooth to drive the toothed surface to reciprocate the slide valve element;

a trigger pivotably mounted to said trigger housing for manual pivoting toward said pistol grip while manually grasping the pistol grip;

a lever arm fastened to said trigger for pivoting therewith;

an elongated link pivotably connected at one end to said lever arm and at an opposite end to said segment gear to transmit pivoting of said lever arm to pivoting of said segment gear.

2. The firefighting nozzle of claim 1, wherein said segment gear, said lever arm and said link define a four-bar linkage between the pivot mounts of said segment gear and said trigger.

3. The firefighting nozzle of claim 2, wherein said segment gear, said lever arm and said link are configured so that said link is at an angle $\alpha$ relative to a line between the pivot mount of said trigger and the pivot connection of said link to said segment gear, said angle $\alpha$ being between 0-90°.

4. The firefighting nozzle of claim 3, wherein when said segment gear is at a position in which the slide valve element is at a maximum flow position for fluid flow through the barrel the angle $\alpha$ is less than 10°.

5. The firefighting nozzle of claim 1, wherein:

the lever arm has a length from the pivot mount of the trigger to the pivot connection of said lever arm to said link; and the trigger assembly is provided with optional lever arms having different lengths to adjust the maximum flow position for fluid flow through the barrel, in which the shorter length provides a maximum fluid flow less than a longer length.

6. The firefighting nozzle of claim 1, further comprising a damper element mounted within the trigger housing and pivotably connected to said segment gear to dampen pivoting movement of said segment gear.

7. The firefighting nozzle of claim 6, wherein said damper element includes:

a piston cylinder defined within said trigger housing and open at one end toward said segment gear and closed at an opposite end;

a damper piston slidably disposed within said piston cylinder, said piston including a rod extending through said one end and pivotably connected to said gear segment and a piston body in reciprocating sealed contact with said piston cylinder; and damper fluid disposed within a damping chamber in said piston cylinder between said piston body and said closed opposite end of said piston cylinder.

8. The firefighting nozzle of claim 7, wherein said piston cylinder includes a seal at said one end to define a second damping chamber between said piston body and said seal at said one end.

9. The firefighting nozzle of claim 8, wherein said damper piston includes a central bore defined through said piston body in communication with said damping chamber and a cross bore defined in said rod in communication with said second damping chamber and said central bore.

10. The firefighting nozzle of claim 9, wherein said damper element includes an adjustment element adjustably mounted at said opposite end of said piston cylinder to be adjustably disposed within said central bore and having a position in which the adjustment element permits fluid communication between said damping chamber and said second damping chamber through said central bore, and a position in which the adjustment element prevents fluid communication between said damping chamber and said second damping chamber through said central bore.

11. The firefighting nozzle of claim 1, wherein said slide valve element has a net area for pressure to act upon it in the axial closing direction of said barrel of less than 0.1 square inches.

12. The firefighting nozzle of claim 1, wherein said trigger assembly includes;

a locking lever pivotably mounted on said trigger, and an interlocking engagement between said locking lever and said trigger housing when said locking lever is pivoted toward said trigger housing.

13. The firefighting nozzle of claim 12, wherein said locking lever is spring biased relative to said trigger to bias said locking lever away from said interlocking engagement.

14. A firefighting nozzle comprising:

an elongated barrel having an inlet opening at one end for engaging a source of fluid under pressure and an outlet opening at an opposite end for engaging a discharge element for dispensing the fluid under pressure, wherein the inlet opening defines an inlet axis and the outlet opening defines an outlet axis that is substantially parallel to the inlet axis;

a valve arrangement disposed within said barrel between said inlet opening and said outlet opening, said valve arrangement configured to adjust the flow of fluid through the barrel and including a slide valve element slidably mounted within the barrel for reciprocating movement along the length of the barrel; and a trigger assembly detachably mountable on said barrel and including;

a trigger housing defining a pistol grip oblique to said outlet axis and configured for manual grasping during operation of the firefighting nozzle; and a trigger pivotably mounted to said trigger housing;

a linkage mechanism connected to said trigger; and an engagement between the linkage mechanism and said slide valve, said linkage mechanism and said engagement configured so that pivoting movement of said trigger causes reciprocation of said slide valve between said inlet opening and said outlet opening to control fluid flow from said inlet opening to said outlet opening.

15. The firefighting nozzle of claim 14, wherein said inlet axis and said outlet axis are substantially collinear.

16. The firefighting nozzle of claim 14, wherein said inlet axis is non-parallel and non-collinear with said trigger housing.

17. A firefighting nozzle comprising:

an elongated barrel having a inlet opening at one end for engaging a source of fluid under pressure and an outlet opening at an opposite end for engaging a discharge element for dispensing the fluid under pressure, wherein the inlet opening defines an inlet axis and the outlet opening defines an outlet axis that is substantially parallel to the inlet axis;

a valve arrangement disposed within said barrel between said inlet opening and said outlet opening, said valve arrangement configured to adjust the flow of fluid through the barrel and including a slide valve element slidably mounted within the barrel for reciprocating movement along the length of the barrel; and at least two trigger assemblies selectably mountable on said barrel, each trigger assembly including;

a trigger housing defining a pistol grip for manual grasping during operation of the firefighting nozzle; and a trigger pivotably mounted to said trigger housing;

a linkage mechanism connected to said trigger; and an engagement between the linkage mechanism and said slide valve, whereby actuation of said trigger causes reciprocation of said slide valve to control fluid flow from said inlet opening to said outlet opening, wherein the linkage mechanism differs between the at least two trigger assemblies to provide a different range of reciprocation of the slide valve between trigger assemblies.

18. The firefighting nozzle of claim 14, wherein said linkage mechanism includes a four-bar linkage.

* * * * *